US010364610B2

(12) United States Patent
Beavers et al.

(10) Patent No.: US 10,364,610 B2
(45) Date of Patent: Jul. 30, 2019

(54) DURABLE ROCK BIT FOR BLAST HOLE DRILLING

(71) Applicant: Varel International Ind., L.P., Carrollton, TX (US)

(72) Inventors: Tony Jack Beavers, Denton, TX (US); Amnach Kongamnach, Lavon, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 94 days.

(21) Appl. No.: 15/670,118

(22) Filed: Aug. 7, 2017

(65) Prior Publication Data

US 2018/0044993 A1 Feb. 15, 2018

Related U.S. Application Data

(60) Provisional application No. 62/372,493, filed on Aug. 9, 2016.

(51) Int. Cl.

| | |
|---|---|
| ***E21B 10/08*** | (2006.01) |
| ***E21B 10/16*** | (2006.01) |
| ***E21B 10/18*** | (2006.01) |
| ***E21B 10/23*** | (2006.01) |

(Continued)

(52) U.S. Cl.

CPC ..... *E21B 10/23* (2013.01); *E21B 10/08* (2013.01); *E21B 10/16* (2013.01); *E21B 10/18* (2013.01); *E21B 10/61* (2013.01); *E21B 10/50* (2013.01)

(58) Field of Classification Search

CPC ..... E21B 10/18; E21B 10/23; E21B 10/61; E21B 10/50; E21B 2010/607; E21B 17/10; E21B 17/1085; E21B 17/1092

See application file for complete search history.

(56) References Cited

U.S. PATENT DOCUMENTS 1,236,983 A * 8/1917 Reed ..... E21B 10/18 175/340
1,263,802 A * 4/1918 Reed ..... E21B 10/18 175/340

(Continued)

FOREIGN PATENT DOCUMENTS

CA 2827989 A1 * 8/2012 ..... E21B 7/18
CN 2457815 2/2002

(Continued)

OTHER PUBLICATIONS

European Search Report; European Patent Application No. 17185066.2-1005; dated Jan. 9, 2018.

*Primary Examiner* — Jennifer H Gay

(57) ABSTRACT

A rock bit for blast hole drilling includes: a bit body having a coupling formed at an upper end thereof, a plurality of lower legs, a dome formed between the legs, and a bore formed through the coupling and the dome; a plurality of skirts, each skirt covering a gap formed between adjacent legs and each skirt mounted to edges of adjacent legs; a plurality of roller cones, each rotary cone rotatably mounted to a respective bearing shaft of a respective leg; a row of gage cutters mounted to each roller cone; a row of inner cutters mounted to each roller cone; one or more nose cutters mounted to each roller cone; and a center jet secured in the bore. Each cutter is an insert.

16 Claims, 6 Drawing Sheets

(51) Int. Cl.
*E21B 10/50* (2006.01)
*E21B 10/61* (2006.01)

(56) References Cited

U.S. PATENT DOCUMENTS 3,125,174 A * 3/1964 Medlock et al. ..... E21B 10/23 175/337
3,401,758 A * 9/1968 Talbert ..... E21B 10/18 175/318
3,439,757 A 4/1969 Elenburg
3,823,789 A 7/1974 Garner
3,948,330 A * 4/1976 Langford, Jr. ..... E21B 10/18 175/339
4,067,406 A * 1/1978 Garner ..... E21B 10/16 175/341
4,126,194 A * 11/1978 Evans ..... E21B 10/18 175/340
4,646,858 A * 3/1987 Strickland ..... E21B 10/18 175/337
4,781,770 A * 11/1988 Kar ..... B23K 26/34 148/220
4,823,890 A 4/1989 Lang
5,137,097 A 8/1992 Fernandez
5,199,516 A * 4/1993 Fernandez ..... E21B 10/16 175/228
5,452,771 A * 9/1995 Blackman ..... E21B 10/25 175/353
5,535,838 A * 7/1996 Keshavan ..... C23C 4/06 175/374
5,775,446 A * 7/1998 Lott ..... E21B 10/18 175/424
5,853,055 A 12/1998 Siracki
5,996,713 A * 12/1999 Pessier ..... E21B 17/1092 175/353
6,408,957 B1 * 6/2002 Slaughter, Jr. ..... E21B 21/002 175/235
6,450,270 B1 * 9/2002 Saxton ..... E21B 10/18 175/339
6,581,702 B2 6/2003 Dickey
2001/0050187 A1 * 12/2001 Slaughter, Jr. ..... E21B 10/003 175/228
2004/0069534 A1 * 4/2004 Larsen ..... E21B 10/18 175/57
2007/0284151 A1 * 12/2007 Pessier ..... E21B 10/50 175/374
2009/0152013 A1 * 6/2009 Buske ..... B23K 9/048 175/340
2013/0081881 A1 * 4/2013 Kongamnach ..... E21B 10/16 175/374
2013/0133956 A1 * 5/2013 Jones ..... E21B 10/60 175/393
2015/0308199 A1 * 10/2015 Finnman ..... E21B 10/16 175/432
2016/0160569 A1 * 6/2016 Peterson ..... E21B 10/23 175/57
2018/0044993 A1 * 2/2018 Beavers ..... E21B 10/18
2018/0112469 A1 * 4/2018 Ghaziani ..... B05B 3/06
2018/0340375 A1 * 11/2018 Schroder ..... E21B 10/50

FOREIGN PATENT DOCUMENTS

CN 203463013 3/2014
GB 1477069 A 6/1977
RU 2222683 1/2004
WO WO-0029709 A2 * 5/2000 ..... E21B 17/1092

* cited by examiner

DURABLE ROCK BIT FOR BLAST HOLE DRILLING

BACKGROUND OF THE DISCLOSURE

Field of the Disclosure

The present disclosure generally relates to a durable rock bit for blast hole drilling.

Description of the Related Art

CN 2475815 discloses a cone bit, particularly a hydraulic structure for a tri-cone bit, which includes three cone legs. The upper parts of the three cone legs are combined into a whole, the lower end of each cone leg is provided with a cone, and the middle part of the lower part of a bit body is provided with a center nozzle. The periphery of the bit body between the cone legs is provided with a wiper block which is provided with a reverse edge nozzle with an upward jet hole. An auxiliary nozzle can also be arranged along the circumferential direction of the center nozzle. The bit effectively improves a flow field at the bottom of a well and enhances the rock removing effect of the main jet in order to enhance the speed rate of a well drilling to reduce the integrated cost of the well drilling.

CN 203463013 discloses a tricone bit including a bit main body and a bit cone leg which is arranged on the bit main body; a bit cone is arranged on the bit cone leg; the back of the bit cone leg is provided with an oil storage compensation pressure balance system; the middle of the bit main body is provided with a center water hole; one end of the center water hole, which is close to the bit cone, is provided with a replaceable alloy nozzle. An alloy nozzle holder which is arranged in the center water hole of the tricone bit is convenient to machine, the alloy nozzle is convenient to replace, the different diameters of alloy nozzles can be replaced according to the working conditions, and accordingly workers can perform well drilling well by utilizing the water power of the drilling fluid; the space of a rising rock debris flow channel which is formed by machining is sufficient and accordingly rock debris can rise and the mechanical drilling speed can be improved; the oil storage compensation pressure balance system is arranged on the back side of the bit cone leg and accordingly the distance to a bearing is small and the grease compensation is timely and meanwhile an oil storage compensation pressure balance and bearing sealing system is integral and effective and accordingly the service life of the tricone bit can be greatly extended.

RU 2222683 discloses a roller bit including arms making body of bit, rolling cutters mounted in bearing assemblies and nozzle with cone internal hydraulic conduit located in central hole of body. Six longitudinal slits are made in wall of nozzle. Three equal slits with larger areas of outlet sections which expand along length from center to periphery of roller bit are arranged uniformly and are strictly directed into spaces between rolling cutters and three equal slot-shaped slits with smaller areas of outlet sections have identical width and are directed with inclination to surfaces of rolling cutters and their axes in plan are displaced with reference to axes of rolling cutters in direction of rotation of bit through angle alpha=15/25 DEG. Summary areas of outlet sections of larger and smaller slits are interrelated by following relationship SigmaFl.a/SigmaFs.a=(2.0/3.5), where SigmaFl.a and SigmaFs.a are summary areas of outlet sections of correspondingly larger and smaller slits, sq mm.

U.S. Pat. No. 3,439,757 discloses a well drilling apparatus for preventing excessive flow of fluid into a formation while at the same time maintaining the cones of a bit free from the cuttings. This apparatus includes concentrically arranged drilling pipes flow connected to a sub with the sub having a formation cutting bit attached to the lower depending end thereof. The sub and bit include longitudinally extending passageways, with one such passageway centrally extending through the sub and bit and into communication with the tubing located within the drill pipes, and with the remaining passageways being radially arranged to communicate with the annulus of the drill pipes. A cylindrical downwardly depending skirt is rigidly attached to the sub and downwardly depends about the drill bit, thereby enclosing the drill shanks therewithin. A weir in the form of a plate member is attached between adjacent shanks and is spaced apart from and enclosed by the lower terminal end of the skirt thereby providing a passageway for clean drilling fluid which flows from the drill pipe annulus and between the weir and skirt. The passageway forces the clean fluid to flow in close proximity of the drill cones to thereby maintain the cones free of debris in an improved manner. This action also removes large formation cuttings from the vicinity of the drill bit so as to prohibit further reduction in their size, thereby effecting a savings in the expenditure of power which must be used by the cone, as well as immediately returning large cuttings or chips of the formation to the surface for analysis.

U.S. Pat. No. 4,823,890 discloses a reverse circulation deep hole rock bit that includes a drill bit connector tube telescopically extended into a drill bit housing to cooperatively form a part of a radial inner fluid channel for cuttings to flow axially outwardly and a radial outer annular clearance space, a plurality of angularly spaced pressurized fluid passage that open to the annular space and a check valve in each fluid passage to permit inward flow of fluid, but to block fluid flow in the opposite direction. A plurality of angularly spaced cutter arms have arcuate tubular segments secured to axial and radial outer portions of the arms while a radially inner tubular skirt is secured to or abuts against the axial outer portions of the arms. The combination of segments, arms and skirt are secured to the housing to extend inwardly thereof with the skirt forming part of the radial inner return channel while each passage opens to a separate chamber angularly between adjacent arms to direct pressurized fluid to flow between the rotary cutters that are mounted by the arms and convey cuttings outwardly through the radial inner fluid channel.

U.S. Pat. No. 5,853,055 discloses a rotary cone bit for drilling bore holes in earth formations whose body has a thread pin end and a dome end from which extend three legs. A cutter cone is rotatably mounted to each leg and is radially oriented about the bit's central axis. Each cutter cone has a gage row of cutting elements extending from the cone surface nearest the mouth and a nose row extending nearest the cone's apex. A center jet for emitting fluid or mud is located on the dome. The jet has a converging nozzle with an exit orifice which extends below a predefined horizontal plane intersected by the cones or cutting elements. The exit orifice has a constant diameter for a length at least equal to its diameter for reducing the diffusion of the fluid or mud flow emitted. Fluid or mud emitted from the center jet travels substantially uninterrupted within a cylindrical space between the cones which is not invaded by any cutting element. This reduced diffusion substantially uninterrupted fluid flow strikes the bore hole bottom with maximum impact energy for enhanced removal of earth formation cuttings.

U.S. Pat. No. 6,581,702 discloses a three-cone rock bit employing a non-plugging center jet nozzle with a plurality of staggered inlet orifices leading to side passageways to reduce bit balling. The nozzle defines a tapered cavity through which drilling mud flows and exits in streams. Streams are directed from the nozzle through a main exit aperture of sufficient size to avoid plugging and from side passageways boring through a sidewall of the nozzle. Jetting streams promote washing of voids within the bit and of cutting surfaces. The nozzle uses staggered inlet orifices leading to side passageways, in conjunction with a tapering shape of a central passageway to facilitate maintenance of drilling mud velocity within the central passageway and thus of stream velocity to targeted regions of the drill bit.

SUMMARY OF THE DISCLOSURE

The present disclosure generally relates to a durable rock bit for blast hole drilling. In one embodiment, a rock bit for blast hole drilling includes: a bit body having a coupling formed at an upper end thereof, a plurality of lower legs, a dome formed between the legs, and a bore formed through the coupling and the dome; a plurality of skirts, each skirt covering a gap formed between adjacent legs and each skirt mounted to edges of adjacent legs; a plurality of roller cones, each rotary cone rotatably mounted to a respective bearing shaft of a respective leg; a row of gage cutters mounted to each roller cone; a row of inner cutters mounted to each roller cone; one or more nose cutters mounted to each roller cone; and a center jet secured in the bore. Each cutter is an insert.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1B:
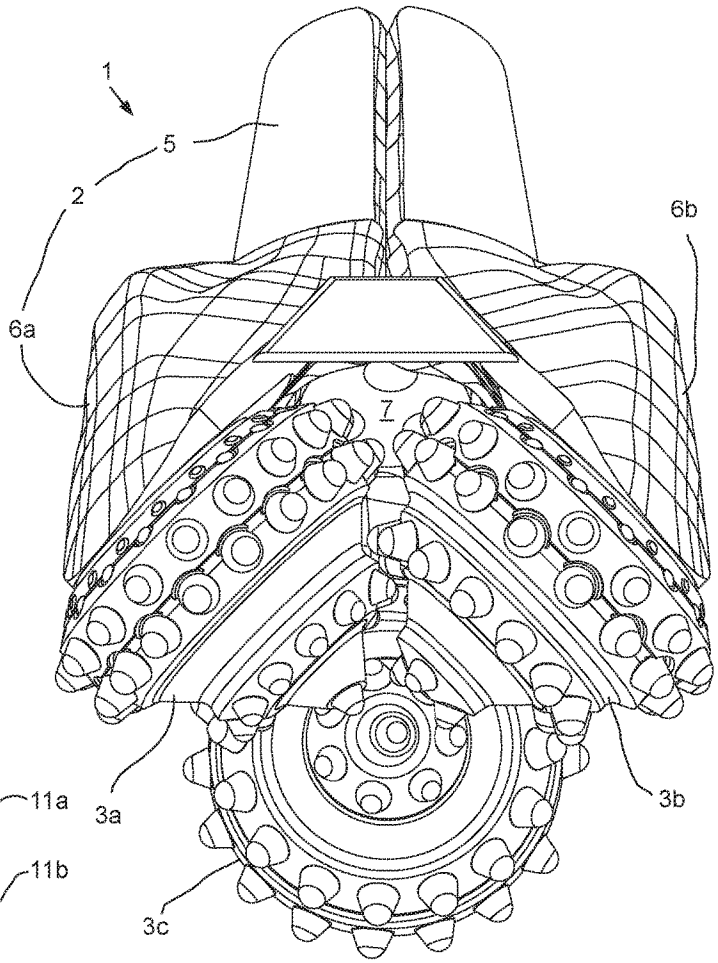
FIGS. 1A and 1B illustrate a durable rock bit for blast hole drilling, according to one embodiment of the present disclosure.
Figure 1A:
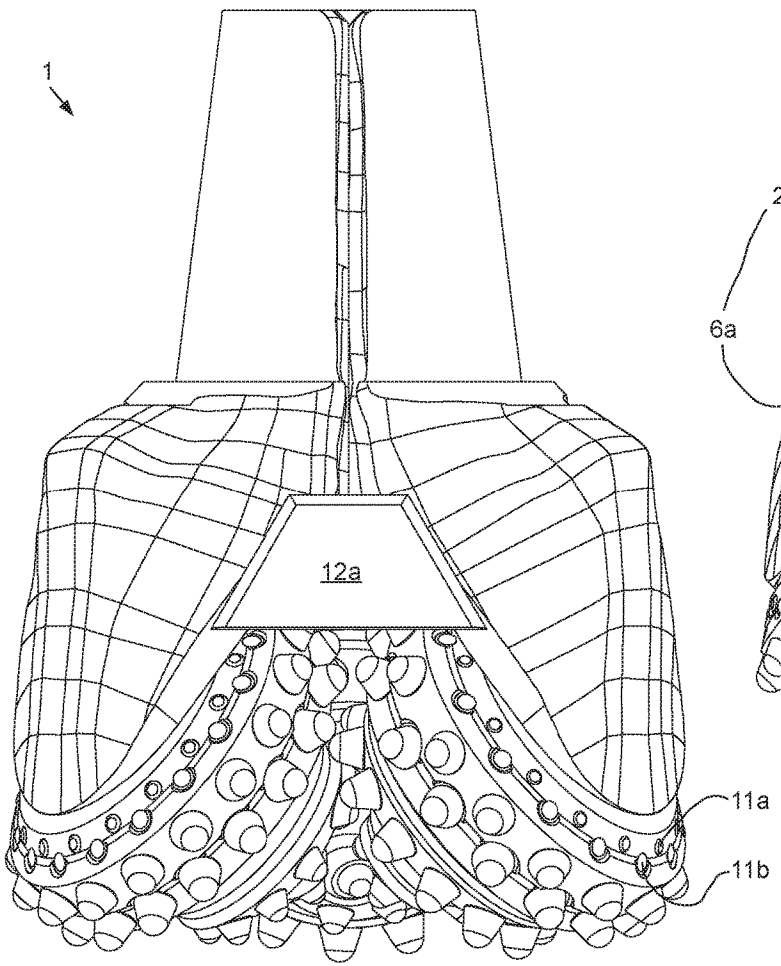
Figure 2B:
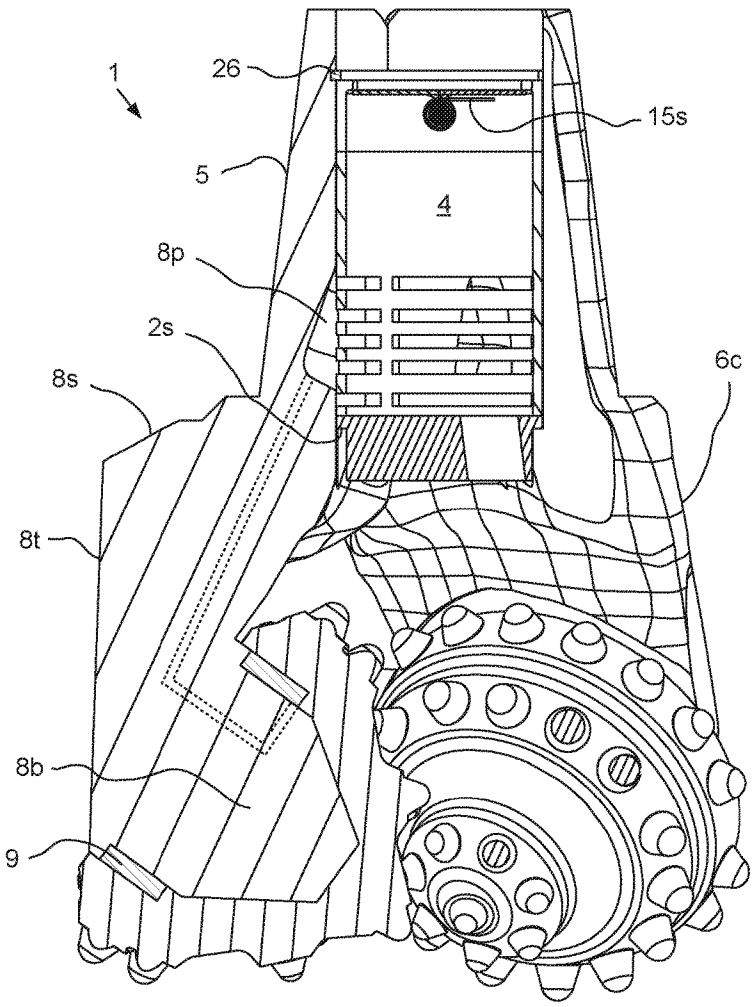
FIGS. 2A and 2B are cross-sectional views of the rock bit.
Figure 2A:
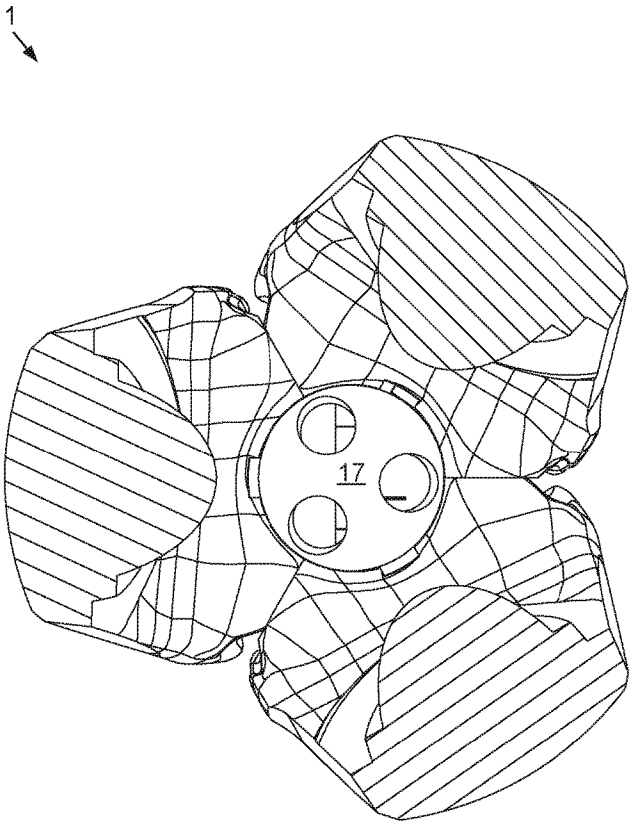
Figure 3A:
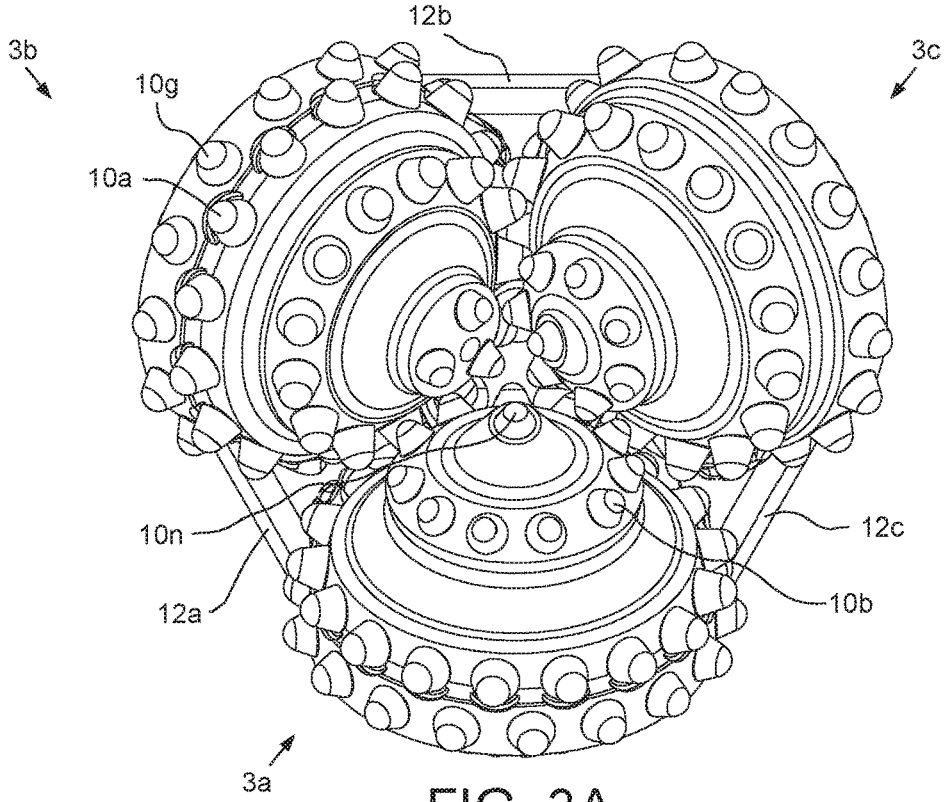
FIG. 3A is an end view of the rock bit.

FIGS. 1A and 1B illustrate a durable rock bit 1 for blast hole drilling, according to one embodiment of the present disclosure. FIGS. 2A and 2B are cross-sectional views of the rock bit 1. FIG. 3A is an end view of the rock bit 1. The rock bit 1 may include a body 2, a plurality of roller cones 3*a-c*, and a center jet 4. The body 2 may have an upper coupling 5, a lower leg 6*a-c* for each roller cone 3*a-c*, and a dome 7 formed between the legs. The body 2 and the roller cones 3*a-c* may each be made from a metal or alloy, such as steel. The body 2 may be made by attaching three forgings together, such as by welding. The legs 6*a-c* may be equally spaced around the body, such as three at one hundred twenty degrees. The upper coupling 5 may be a threaded pin for connection to a drill rod (not shown). A bore may be formed through the coupling and the dome 7 for discharging drilling fluid, such as air, onto interfaces between the cones 3*a-c*.

Each leg 6*a-c* may have an upper shoulder 8*s*, a mid shirttail 8*t*, and a lower bearing shaft 8*b*. Each bearing shaft 8*b* may extend from the respective shirttail 8*t* in a radially inclined direction. Each bearing shaft 8*b* and the respective cone 3*a-c* may have one or more pairs of aligned grooves and each pair may form a race for receiving a set of roller bearings 9. One or more thrust washers (not shown) may be disposed between each bearing shaft 8*b* and the respective cone 3*a-c*. The roller bearings 9 and thrust washers may support rotation of each cone 3*a-c* relative to the respective leg 6*a-c*. Each leg 6*a-c* may have a passage 8*p* (only partially shown) extending from the bore to the bearings, thereby utilizing the drilling fluid for cooling and lubrication.

Alternatively, each leg 6*a-c* may include a pressure balanced lubricant reservoir, each passage 8*p* may lead to the respective reservoir instead of the bore, and a seal may be disposed between each bearing shaft 8*b* and the respective cone 3*a-c*.

Each roller cone 3*a-c* may be mounted to the respective leg 6*a-c* by a plurality of balls (not shown) received in a race formed by aligned grooves (not shown) in each roller cone and the respective bearing shaft 8*b*. The balls may be fed to each race by a ball passage (not shown) formed in each leg 6*a-c* and retained therein by a respective ball plug (not shown). Each ball plug may be attached to the respective leg 6*a-c*, such as by welding.

Each roller cone 3*a-c* may have a plurality of lands formed therein, such as one or more heel lands, a gage land, one or more inner lands, and a nose land. A row of gage cutters 10*g* may be mounted around each cone 3*a-c* at the respective gage land. A row of first inner cutters 10*a* may be mounted around each cone 3*a-c* at a respective first one of the inner lands. A row of second inner cutters 10*b* may be mounted around each cone 3*a-c* at a respective second one of the inner lands. One or more nose cutters 10*n* may be mounted on each cone 3*a-c* at the respective nose land. Each cutter 10*a,b,g,n* may be an insert mounted in a respective socket formed in the respective cone 3*a-c* by an interference fit. Each cutter 10*a,b,g,n* may be made from a cermet, such as a cemented carbide, and may have a cylindrical portion mounted in the respective cone and a conical portion protruding from a respective land of the respective cone 3*a-c*.

A row of first inner protectors 11*a* (FIG. 1A) may be mounted around each cone 3*a-c* at a respective first one of the heel lands. A row of second inner protectors 11*b* (FIG. 1A) may be mounted around each cone 3*a-c* at a respective second one of the heel lands. Each protector 11*a,b* may be an insert mounted in a respective socket formed in the respective cone 3*a-c* by an interference fit. Each protector 11*a,b* may be made from a cermet, such as a cemented carbide, and may be cylindrical.

Alternatively, at least some of the cutters 10*a,b,g,n* may be capped with polycrystalline diamond (PCD). Alternatively, at least some of the protectors 11*a,b* may be capped with PCD. Alternatively, each cutter 10*a,b,g,n* may have a protruding wedge portion instead of a protruding cylindrical portion.

The rock bit 1 may further include a plurality of skirts 12*a-c* for directing flow of drilling fluid discharged from the center jet 4 onto the interfaces between the cones 3*a-c*. The skirts 12*a-c* may each cover a gap formed between adjacent legs 6*a-c* to prevent the drilling fluid from flowing therethrough to an annulus formed between the drill rod and drill bit and a wall of the blast hole. Each skirt 12*a-c* may be mounted to edges of adjacent legs 6*a-c*, such as by welding. Each skirt 12*a-c* may be made from a metal or alloy, such as steel. Each skirt 12*a-c* may be trapezoidal plate extending straight across the respective gap.

Figure 3B:
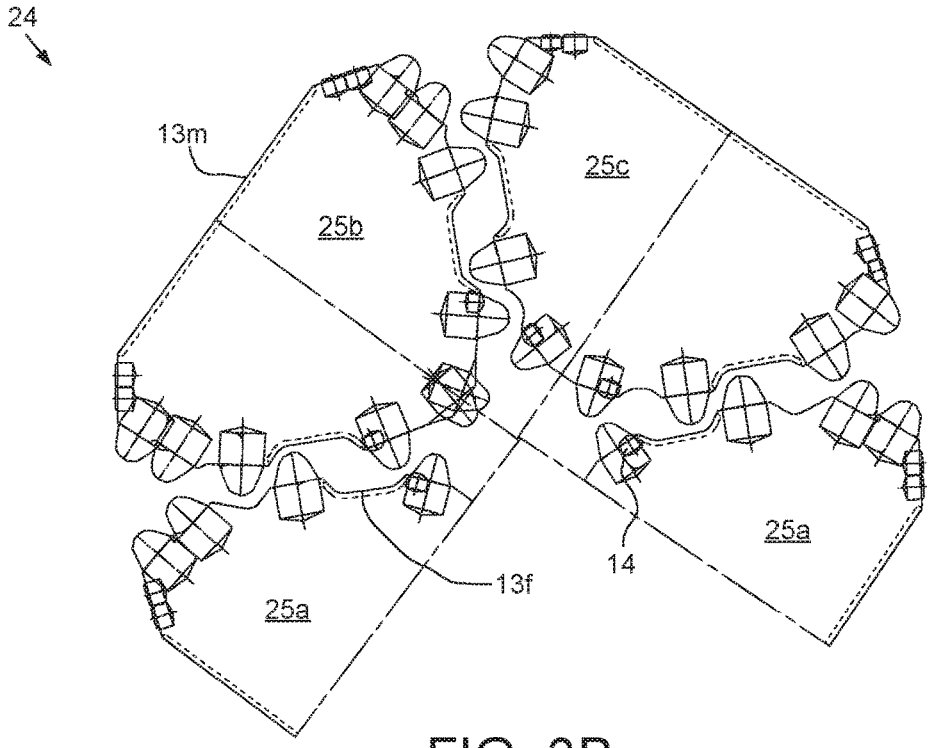
FIG. 3B is a cutting diagram of a first alternative durable rock bit for blast hole drilling, according to another embodiment of the present disclosure.

FIG. 3B is a cutting diagram of a first alternative durable rock bit 24 for blast hole drilling, according to another embodiment of the present disclosure. The first alternative rock bit 24 may be similar to the rock bit 1 except for having modified roller cones 25*a-c* instead of the roller cones 3*a-c*. Selected portions 13*f,m* of each modified roller cone 25*a-c* may be treated to resist erosion. The portions 13*f,m* may include a mouth 13*m* of each modified cone 25*a-c* and a face 13*f* of each cone located between the respective second inner land and the respective nose land. The treatment may include case hardening, such as carburizing, and/or a layer of hardfacing. The hardfacing may be a ceramic or cermet. A set of interstitial protectors 14 may be mounted on each modified cone 25*a-c* at the respective nose land and between adjacent nose cutters. Each interstitial protector 14 may be made from a cermet, such as a cemented carbide, and may have a cylindrical portion mounted in the respective cone and a dome portion protruding from a respective nose land of the respective modified cone 25*a-c*.

Alternatively, additional portions of the modified cones 25*a-c* may be treated to resist erosion, such as portions of the lands between the cutters, faces of the cones between the gage and inner rows and/or between the first and second inner rows. Alternatively, additional sets of interstitial protectors may be mounted to the modified cones 25*a-c* at the inner lands between adjacent cutters and/or at the gage land between adjacent cutters.

Figure 4A:
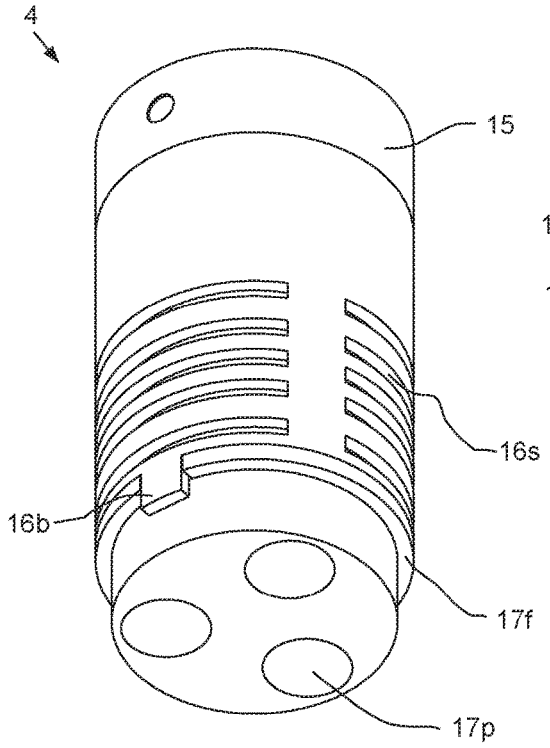
FIGS. 4A and 4B illustrate a center jet of the rock bit.
Figure 4B:
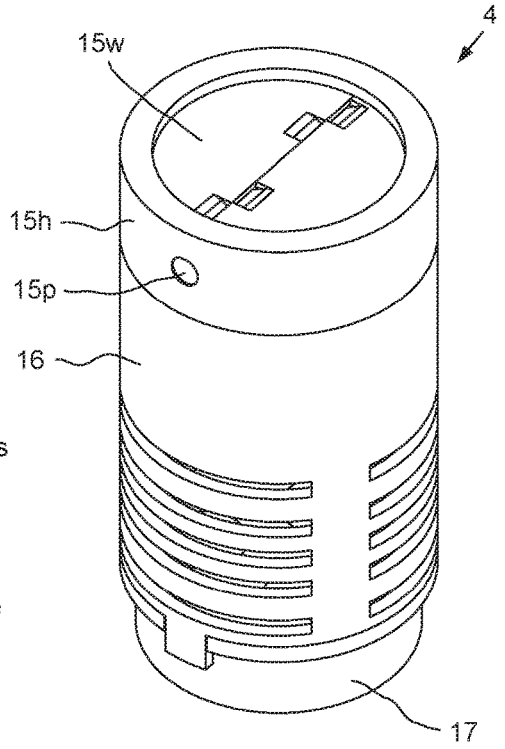
Figure 4C:
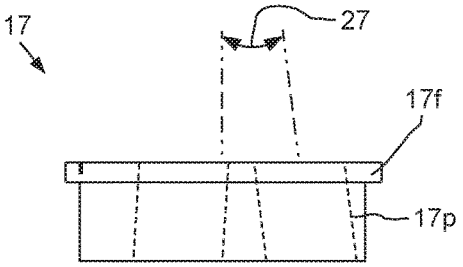
FIGS. 4C and 4D illustrate an orifice plate of the center jet.
Figure 4D:
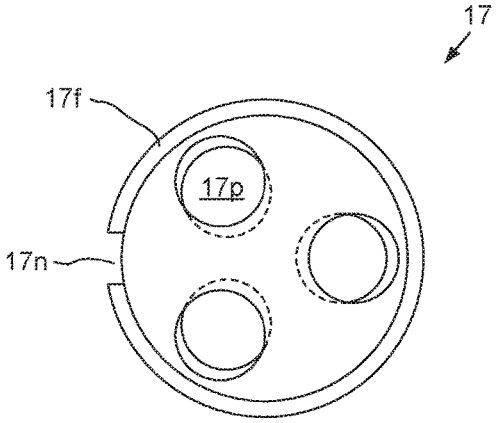
Figure 5A:
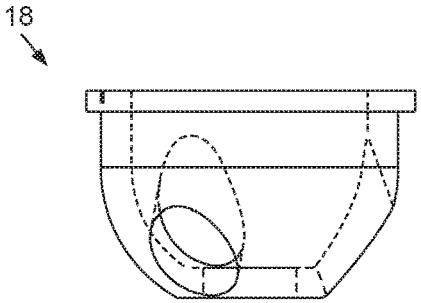
FIGS. 5A-5H illustrate alternative orifice plates usable with the center jet instead of the orifice plate, according to other embodiments of the present disclosure.
Figure 5C:
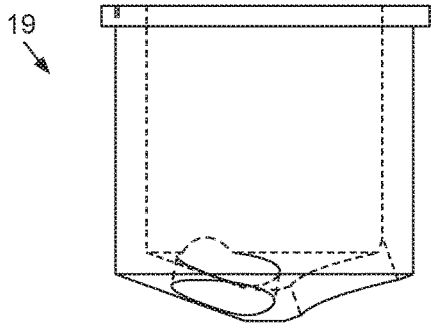
Figure 5B:
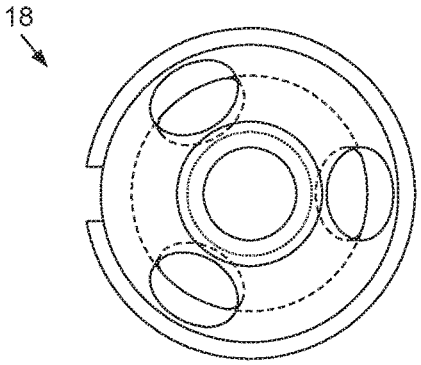
Figure 5D:
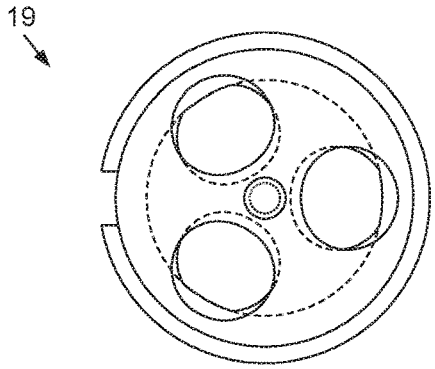
Figure 5E:
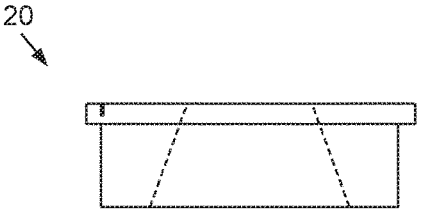
Figure 5G:
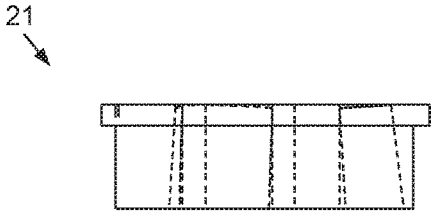
Figure 5F:
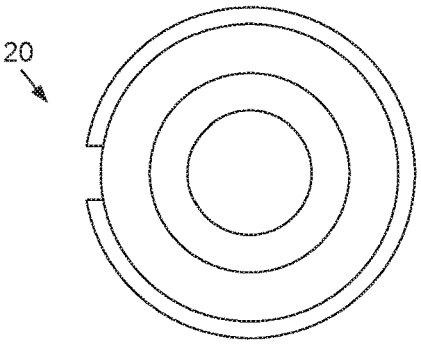
Figure 5H:
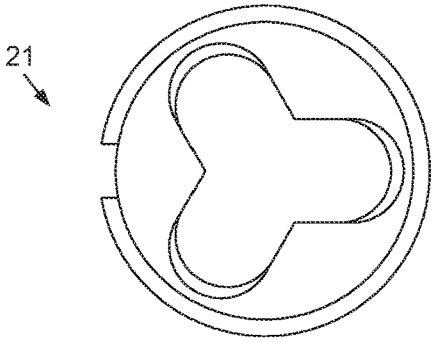

FIGS. 4A and 4B illustrate the center jet 4. FIGS. 4C and 4D illustrate an orifice plate 17 of the center jet 4. Referring also to FIG. 2B, the center jet 4 may be disposed in the bore of the bit body 2 and may have an outer diameter corresponding to an inner diameter thereof, such as equal to or slightly less than, to form a sliding fit between the center jet and the bit body. The center jet 4 may be secured in the bore by a fastener, such as a snap ring 26, engaged with a groove (not shown) formed in an upper portion of the bore adjacent to the coupling 5. The center jet 4 may include a back flow valve 15, a screen tube 16, and the orifice plate 17. The components 15-17 of the center jet 4 may be arranged in a stack. Each component 15-17 may be cylindrical. Each of the back flow valve 15 and the screen tube 16 may have a bore formed therethrough.

The back flow valve 15 may include a housing 15*h*, a pair of wings 15*w* pivotally connected to the housing by a hinge pin 15*p*, and a biasing member, such as a torsion spring 15*s* (FIG. 2B). Each wing 15*w* may pivot about the hinge pin 15*h* between an open position (not shown) and a closed position (shown). The torsion spring 15*s* may be wrapped around the hinge pin 15*p* and may bias the wings 15*w* toward the closed position. The housing 15*h* may have a seat formed in an inner surface thereof for receiving a periphery of the wings 15*w* in the closed position, thereby shutting a bore of the housing. The wings 15*w* may be moved from the closed position to the open position by injection of the drilling fluid down the bore of the bit body 2 and may close if flow is ceased or may close to block upward flow. The hinge pin 15*p* may be received in sockets formed in a wall of the housing 15*h* and mounted to the housing, such as by an interference fit.

The screen tube 16 may have set of slots 16*s* formed through a wall thereof for each passage 8*p*. The slots 16*s* may be aligned with inlets of the passages 8*p* and each set of slots may be oriented to face a respective passage. The slots 16*s* may divert a portion of the drilling fluid from the bore thereof to the passages 8*p*. The slots 16*s* may be sized to filter particulates from entering the passages 8*p* and reaching the bearings 9. The screen tube 16 may have an orienting feature, such as a boss 16*b*, formed in a lower end thereof.

The orifice plate 17 may have an outer flange 17*f* formed in an upper end thereof and a port 17*p* formed therethrough for each cone 3*a-c*. The flange 17*f* may have an orienting feature, such as a notch 17*n*, formed therein for mating with the boss 16*b*, thereby torsionally connecting the orifice plate 16 and the screen tube 15. The bit body 2 may also have a seat 2*s* (FIG. 2B) formed therein adjacent to the bore for receiving the flange 17*f* and the seat may also have a notch (not shown) for mating with the boss 16*b* to ensure orientation of the slots 16*s* relative to the passages 8*p* and aiming of the ports 17*p* at the interfaces between the cones 3*a-c*. The ports 17*p* may diverge from the flange to a bottom of the orifice plate 17 to direct discharge of the drilling fluid downward and radially outward toward the interfaces between the cones 3*a-c*. An angle 27 of this divergence (measured relative to a longitudinal centerline of the rock bit 1) may range between three and forty degrees or zero (non-divergent) and sixty degrees.

FIGS. 5A-5H illustrate alternative orifice plates 18-21 usable with the center jet 4 instead of the orifice plate 17, according to other embodiments of the present disclosure. A first alternative orifice plate 18 may have a cylindrical upper portion, a lower dome portion, a plenum formed therein, a side port for each cone 3*a-c*, and a center port. A diameter of each side port may decrease from the plenum to an outer surface of the dome portion to create a nozzle effect. The center port of the first alternative orifice plate 18 may direct discharge of the drilling fluid downward to erode a center of a bottom of the blast hole. The side ports may diverge from the cylindrical upper portion to the lower dome portion to direct discharge of the drilling fluid downward and radially outward toward the interfaces between the cones 3*a-c*. An angle of this divergence (measured relative to a longitudinal centerline of the rock bit 1) may range between three and forty degrees or zero (non-divergent) and sixty degrees.

A second alternative orifice plate 19 may have a cylindrical upper portion, a lower conical portion, a plenum formed therein, a side port for each cone 3*a-c*, and a center port. A diameter of each side port may be substantially greater than a diameter of the center port. The side ports may diverge from the cylindrical upper portion to the lower conical portion to direct discharge of the drilling fluid downward and radially outward toward the interfaces between the cones 3*a-c*. An angle of this divergence (measured relative to a longitudinal centerline of the rock bit 1) may range between three and forty degrees or zero (non-divergent) and sixty degrees.

A third alternative orifice plate 20 may have only one center port. A diameter of the center port may increase from a flange thereof to a bottom thereof to create a diffuser effect. A wall of the third alternative orifice plate 20 adjacent to the center port may be inclined at an angle (measured relative to a longitudinal centerline of the rock bit 1) that may range between three and forty degrees or zero (non-divergent) and sixty degrees.

A fourth alternative orifice plate 21 may have a single Y-shaped port. Each branch portion of the Y-shaped port may diverge from a flange of the fourth alternative orifice plate 21 to a bottom thereof to direct discharge of the drilling fluid downward and radially outward toward the interfaces between the cones 3*a-c*. An angle of this divergence (measured relative to a longitudinal centerline of the rock bit 1) may range between three and forty degrees or zero (non-divergent) and sixty degrees.

Figure 6B:
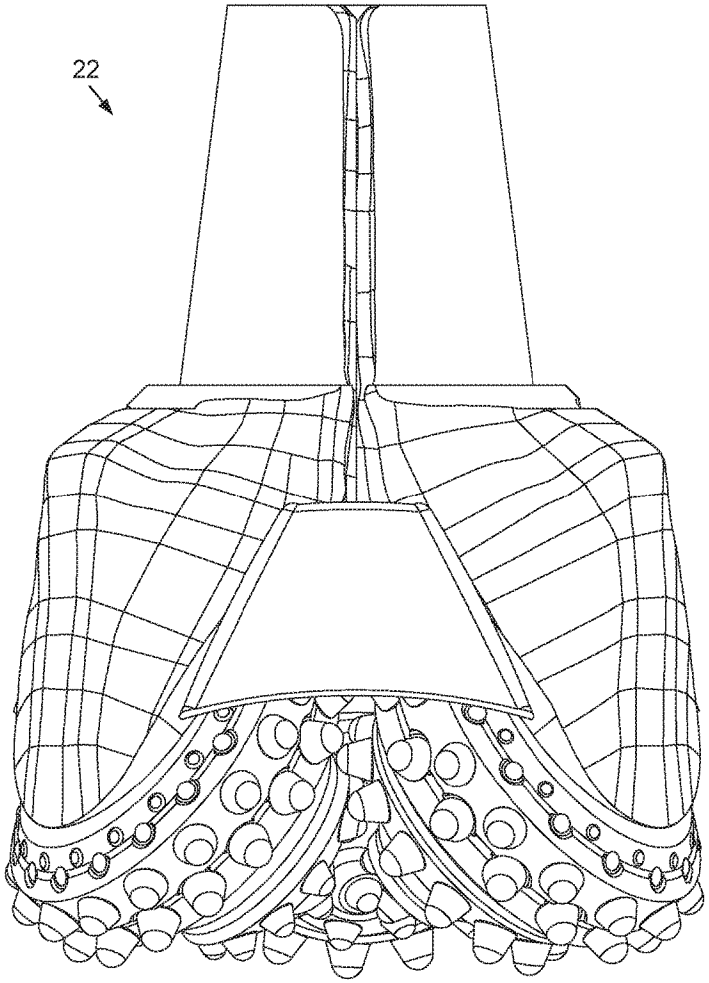
FIGS. 6A and 6B illustrate a second alternative durable rock bit for blast hole drilling, according to another embodiment of the present disclosure.
Figure 6A:
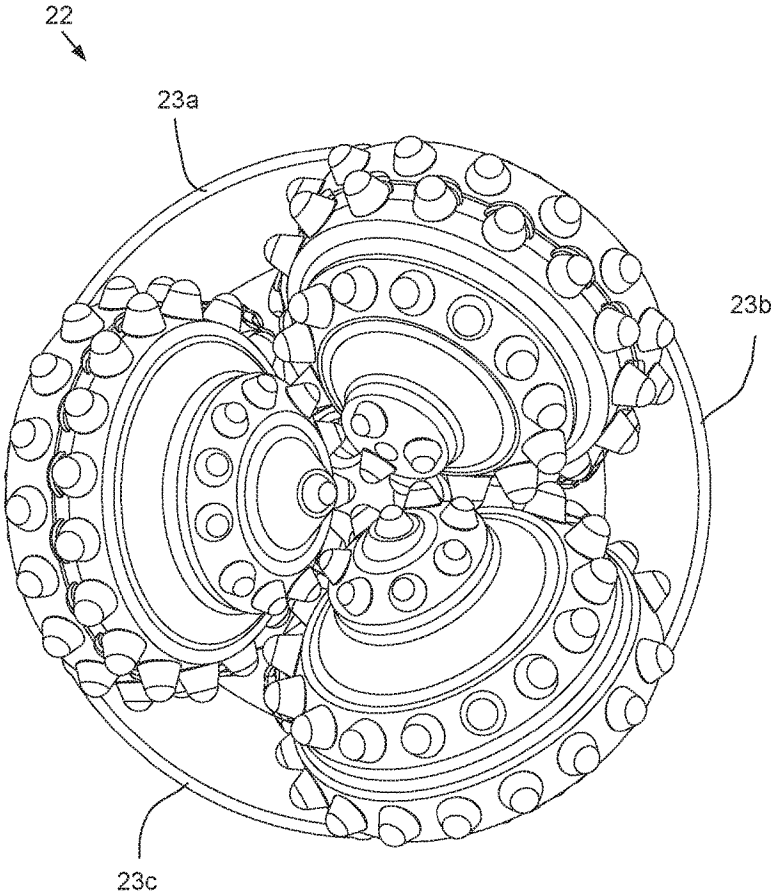

FIGS. 6A and 6B illustrate a second alternative durable rock bit 22 for blast hole drilling, according to another embodiment of the present disclosure. The second alternative rock bit 22 may be similar to the rock bit 1 except for having modified skirts 23*a-c* instead of the skirts 12*a-c*. Each modified skirt 23*a-c* may direct flow of drilling fluid discharged from the center jet 4 onto the interfaces between the cones 3*a-c*. The modified skirts 23*a-c* may each cover a gap formed between adjacent legs 6*a-c* to prevent the drilling fluid from flowing therethrough to the annulus. Each modified skirt 23*a-c* may be mounted to edges of adjacent legs 6*a-c*, such as by welding. Each modified skirt 23*a-c* may be made from a metal or alloy, such as steel. Each modified skirt 23*a-c* may be arcuate and may extend along a curved path across the respective gap, such that when the alternative rock bit 22 is viewed from a bottom thereof, a foot print of the skirts and the gage lands of the cones 3*a-c* resembles a circle.

Advantageously, the center jet 4 and either skirt configuration provide superior cuttings removal capability versus prior art rock bits. Insufficient cuttings removal causes cuttings to stagnate at the bottom of the blast hole until they are sufficiently ground to be evacuated. This regrinding of cuttings produces wear around the shirttail lip, exposes the bearings, and leads to eventual bearing failure. This constant regrind also effects cone integrity. As the cuttings are ground, small, abrasive particles are produced that abrade the metallic cones, exposing a base of the cutters and eventually leading to cutter loss. Further, any of the rock bits 1, 22, 24 may achieve the superior cuttings removal without any additional nozzles or ports besides the center jet 4.

Alternatively, any of the rock bits 1, 22, 24 may be used to drill wellbores for crude oil and/or natural gas exploration and/or production or for geothermal power generation.

While the foregoing is directed to embodiments of the present disclosure, other and further embodiments of the disclosure may be devised without departing from the basic scope thereof, and the scope of the invention is determined by the claims that follow.

The invention claimed is:

1. A rock bit for blast hole drilling, comprising:
- a bit body having a coupling formed at an upper end thereof, a plurality of lower legs, a dome formed between the legs, and a bore formed through the coupling and the dome;
- a plurality of skirts, each skirt covering a gap formed between adjacent legs and each skirt mounted to edges of adjacent legs;
- a plurality of roller cones, each rotary cone rotatably mounted to a respective bearing shaft of a respective leg;
- a row of gage cutters mounted to each roller cone;
- a row of inner cutters mounted to each roller cone;
- one or more nose cutters mounted to each roller cone; and
- a center jet secured in the bore and comprising:
  - an orifice plate having a plurality of ports or a single port with a plurality of branches, each port or branch aimed at an interface between adjacent roller cones; and
  - a back flow valve operable to open in response to injection of drilling fluid down the bore and to close for blocking upward flow through the bore, wherein:
- each cutter is an insert, and
- inner and outer surfaces of each skirt extend straight across the respective gap.

2. The bit of claim 1, wherein:
- the bit further comprises a plurality of sets of roller bearings, each set disposed between a respective cone and a respective bearing shaft, and
- each leg has a passage extending from the bore to the respective set of bearings.

3. The bit of claim 2, wherein:
- the center jet comprises a tube having a plurality of sets of slots aligned with inlets of the passages, and
- each set of slots is oriented to face a respective passage.

4. The bit of claim 1, wherein the orifice plate has the plurality of ports.

5. The bit of claim 4, wherein the orifice plate further has a center port aimed downward.

6. The bit of claim 4, wherein the orifice plate further has a plenum formed therein.

7. The bit of claim 1, wherein the orifice plate has the single port with a center portion aimed downward and the plurality of branch portions.

8. The bit of claim 1, further comprising a set of interstitial protectors mounted on each roller cone.

9. The bit of claim 8, wherein the interstitial protectors are located between adjacent nose cutters.

10. The bit of claim 1, wherein at least a portion of each cone is treated to resist erosion.

11. The bit of claim 10, wherein the treatment is case hardening.

12. The bit of claim 10, wherein the treatment is hardfacing.

13. The bit of claim 10, wherein the treated portion is located between the inner cutters and the nose cutters and at a mouth of each cone.

14. The bit of claim 1, wherein the coupling is a threaded pin.

15. The bit of claim 1, wherein the center jet is the only nozzle or port of the drill bit for discharging fluid to remove cuttings.

16. A rock bit for blast hole drilling, comprising:
- a bit body having a coupling formed at an upper end thereof, a plurality of lower legs, a dome formed between the legs, and a bore formed through the coupling and the dome;
- a plurality of skirts, each skirt covering a gap formed between adjacent legs and each skirt mounted to edges of adjacent legs;
- a plurality of roller cones, each rotary cone rotatably mounted to a respective bearing shaft of a respective leg;
- a row of gage cutters mounted to each roller cone;

a row of inner cutters mounted to each roller cone;

one or more nose cutters mounted to each roller cone; and a center jet secured in the bore and comprising:

an orifice plate having a plurality of ports or a single port with a plurality of branches, each port or branch aimed at an interface between adjacent roller cones; and a back flow valve operable to open in response to injection of drilling fluid down the bore and to close for blocking upward flow through the bore, wherein:

each cutter is an insert, and each skirt is arcuate and extends along a curved path across the respective gap, such that when the rock bit is viewed from a bottom thereof, a foot print of the skirts and gage lands of the cones resembles a circle.

* * * * *